US006579166B2

(12) United States Patent
Abe et al.

(10) Patent No.: US 6,579,166 B2
(45) Date of Patent: Jun. 17, 2003

(54) COIN HOPPER WITH PERIPHERAL COIN TRANSPORT DEVICE

(75) Inventors: Hiroshi Abe, Iwatsuki (JP); Masayoshi Umeda, Iwatsuki (JP)

(73) Assignee: Asahi Seiko Co., LTD, Tokyo (JP)

( * ) Notice: Subject to any disclaimer, the term of this patent is extended or adjusted under 35 U.S.C. 154(b) by 128 days.

(21) Appl. No.: 09/768,648

(22) Filed: Jan. 24, 2001

(65) Prior Publication Data

US 2001/0014838 A1 Aug. 16, 2001

(30) Foreign Application Priority Data

Jan. 28, 2000 (JP) ..... 2000-019889
Dec. 8, 2000 (JP) ..... 2000-375002

(51) Int. Cl.[7] ..... G07D 9/04
(52) U.S. Cl. ..... 453/56
(58) Field of Search ..... 453/32, 56, 57; 221/253, 254, 168; 198/550.01, 550.2

(56) References Cited

U.S. PATENT DOCUMENTS 4,535,794 A * 8/1985 Bellis et al. ..... 453/56
6,328,646 B1 * 12/2001 Abe et al. ..... 453/56

FOREIGN PATENT DOCUMENTS

| | | | |
|---|---|---|---|
| JP | 2-47788 | * 2/1990 | ..... 453/56 |
| JP | 4-262489 | * 9/1992 | ..... 453/56 |
| JP | 5-324986 | * 12/1993 | ..... 453/56 |
| JP | 7000595 | 1/1995 | |
| JP | 11053610 | 2/1999 | |

* cited by examiner

*Primary Examiner*—James R. Bidwell

(57) ABSTRACT

A coin hopper device for dispensing coins in an economical manner is provided having a coin selecting mechanism for storing a first quantity of coins and selecting coins that are to be dispensed. A coin storage member stores a second quantity of coins in bulk and may directly permit coins in the coin storage member to pass operatively to the coin selecting mechanism directly by gravity flow from the coin storage member along a first direction when the stored coins are of a predetermined height. A coin carrier device is mounted adjacent the coin storage member for removing coins from the coin storage member on one side, elevating the coins and then dropping them into the coin selecting mechanism from the same side wherein only a portion of the coins in bulk storage may be lifted at any one time.

17 Claims, 16 Drawing Sheets

COIN HOPPER WITH PERIPHERAL COIN TRANSPORT DEVICE

BACKGROUND OF THE INVENTION

1. Field of the Invention

The present invention relates to a coin dispensing apparatus having a coin hopper that can store and selectively output coins from a bulk storage position and more particularly providing an efficient transferring of coins from a bulk storage member to a coin selector while minimizing any jamming of coins.

2. Description of the Related Art

The efficient dispensing of coins in various forms of machines such as gaming machines and product dispensing machines is well known. A common problem is the tendency for coins to jam and this is frequently an issue of concern in gaming machines having coin handling mechanisms that must store, agitate and dispense a large volume of larger diameter tokens or coins. The terminology "coin" is frequently used as a generic name for both monetary coins, medals, tokens, etc. in this industry.

An example of a high capacity coin hopper can be seen in U.S. Pat. No. 5,190,495. An example of this type of coin hopper can be seen in FIG. 16 wherein the coin hopper device 1 includes a substrate that is angled in an oblique manner to support a rotating disc for segregating and dispensing coins. A motor 5 is connected to a speed reducing transmission unit 17 to provide an output shaft 6 that extends through the substrate 2 at an inclined axis 4. A rotating disc 3 has regularly spaced apertures or holes of a configuration that permits reception of a single coin in each hole. These alignment holes 7 permit the coins to pass through and be retained in a pocket 8 on the undersigned of the rotating disc 3, and accordingly, the coins in a sequential manner can be driven to a position for dispensing. A cylinder support member 9 is fixedly supported to the substrate 2 and is coaxial with the rotating disc 3. An intermediate cylindrical chamber 10 is operatively positioned for rotation adjacent to the support member 9 and can be driven by a separate motor 13 through a pinion gear 14 that engages with a ring gear 12 on the outside surface periphery of the cylinder 10. The cylinder 10 is also aligned with the tilting axial shaft line 4 and has mounted on its internal surface agitation members 11*a* and 11*b* to engage and agitate any coins that enter into the rotating cylinder 10. A bulk coin storage hopper or bowl 15 extends outward from the edge of the cylinder 10 and is held in a fixed position by supports not shown. When a bulk quantity of coins are put into the coin bowl 15, the coins are transported through the cylinder 10 to reach the coin dispensing disc 3 in the support member 9. When the quantity of coins in the coin bowl 15 decrease, the coins can be stirred by the rotation of the cylinder 10 and its agitating projections 11*a* and 11*b*. Contact with these projections 11*a* and 11*b* can cause a coin to be moved from the cylinder 10 into the stationary storage cylinder member 9 due to the inclination of the alignment of the operating parts. This arrangement can help prevent any coins from forming a bridge which can jam or stop the dispensing of coins by the rotating disc 3. Additionally, the storage capacity of the coin bowl 15 and cylinder 10 can be increased since it is positioned downward from the attaching support member 9 and coins can be moved upward to drop into the support member 9. Thus, the coin bowl 15 and the cylinder 10 can store a large number of coins. The weight of the bulk coins, however, means that the motor 13 for driving the cylinder 10 must have a sufficiently large output of torque thereby increasing the cost and maintenance of the coin hopper.

Accordingly, the prior art is still seeking a highly efficient and cost effective coin dispensing apparatus that can handle relatively large coins in a highly efficient and cost effective manner with a high dispensing speed.

SUMMARY OF THE INVENTION

The present invention is to prevent a generation of coin bridges that can cause jamming in a coin hopper, even when the capacity of the coin storage bowl is increased. Another purpose of the present invention is to provide a highly efficient and economical coin hopper.

The present invention utilizes a coin hopper in a coin dispensing apparatus that includes a rotating disc for selecting and dispensing a coin to provide an output of coins, while including a bulk coin storage device or coin retention member which can be mounted adjacent the rotating selector disc. A coin carrier member can be driven at a highly efficient manner to prevent coin jamming while distributing coins from the coin storage or retention member to the rotating selector disc chamber. The coin carrier device can be mounted off axis from the rotating selector disc and can be driven with low power requirements. The quantity of coins that will be delivered to the rotating selector disc can be controlled by adjusting the speed of the coin carrier device. Since the coin carrier device will only carry a portion of the total weight of coins supplied from the bulk hopper or coin retention portion, it is possible to reduce the initial cost and operating cost because the driving force can be reduced. Therefore, a motor of an appropriate size and torque output can be efficiently utilized. Alternatively, a single motor with a speed reducing transmission can drive both the coin carrier device and the rotating selector disc.

The alignment of the operating coin hopper, coin carrier device, and the rotating selector disc can be positioned so that coins are initially moved traverse to the axis of rotation about which the rotating selector disc rotates, lifted and then returned in a traverse manner to slide and drop into the chamber supporting the rotating selector disc. The capacity of the coin bowl can be appropriately increased and can have a support surface slanting to one side adjacent the coin carrier device.

The coin carrier device can utilize an endless rotating band or belt having appropriate projections for contacting and lifting coins which are delivered from the bulk hopper. The band can be formed of individual lengths of identical links or can be a continuous band with sloping projections to support and lift individual coins. The bulk coin storage hopper can be optimized in size to meet a limited storage capacity in a dispensing apparatus and can be operatively positioned relative to the coin carrier device so that coins are directed to one peripheral side of the coin hopper for interfacing with and being picked up by the coin carrier unit. As can be appreciated, the endless belt of the coin carrier unit can be appropriately configured to conserve space since the operative interface with the coins is only for a portion of the annular travel of the belt. Preferably, the belt can be driven from an upper portion, for example in a counter-clockwise direction. The carrier unit will dispense the coins at an inclination that will permit gravity and the sloping surface of the internal surface of the coin hopper to distribute the coins in an efficient manner into a chamber adjacent the rotating selector disc. As can be appreciated, the coins do not directly fall upon the rotating selector disc and thereby prevent a potential for jamming and wear and tear on the rotating selector disc.

Additionally, since a lower torque force is required for driving the coin carrier unit, it is possible to use one driving source that can also power the rotating selector disc.

BRIEF DESCRIPTION OF THE DRAWINGS

The exact nature of this invention will be readily apparent from consideration of the following detailed description in conjunction with the accompanying drawings, wherein.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein to specifically provide a coin hopper with a peripheral coin transport device that moves a portion of the total bulk coins in storage at any one time.

Figure 2:
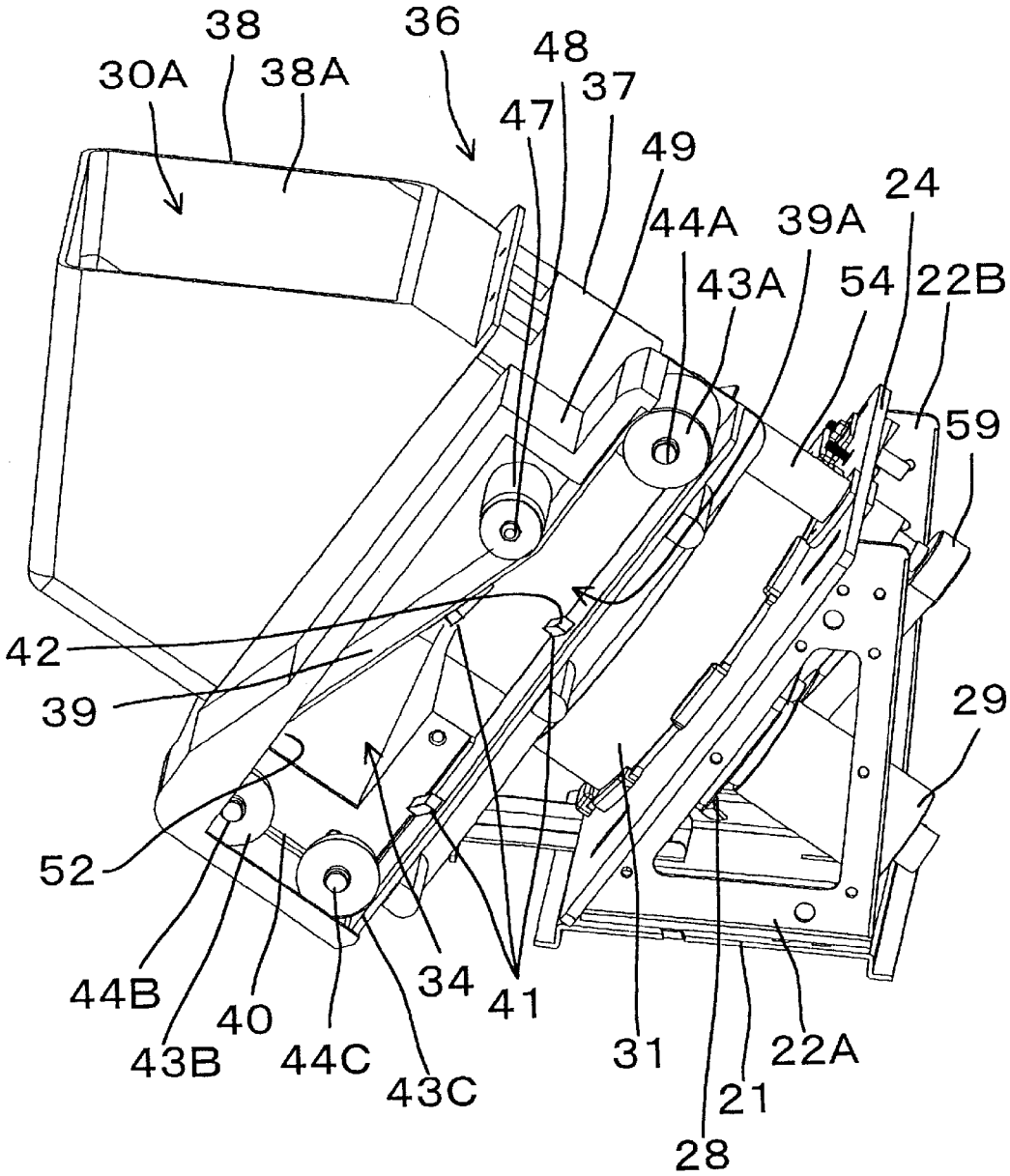
FIG. 2 is a rear side perspective view of FIG. 1.
Figure 3:
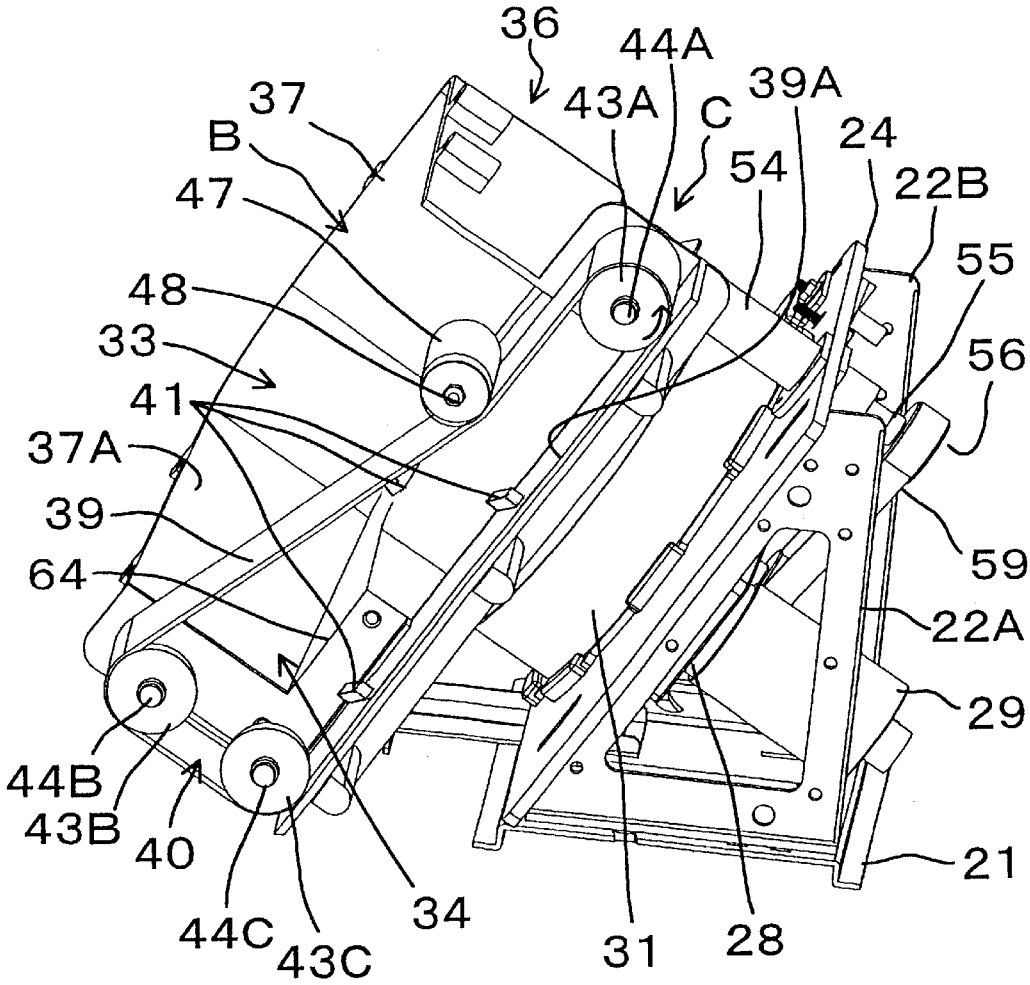
FIG. 3 is a rear side perspective view of FIG. 1 with the coin bowl detached.
Figure 4:
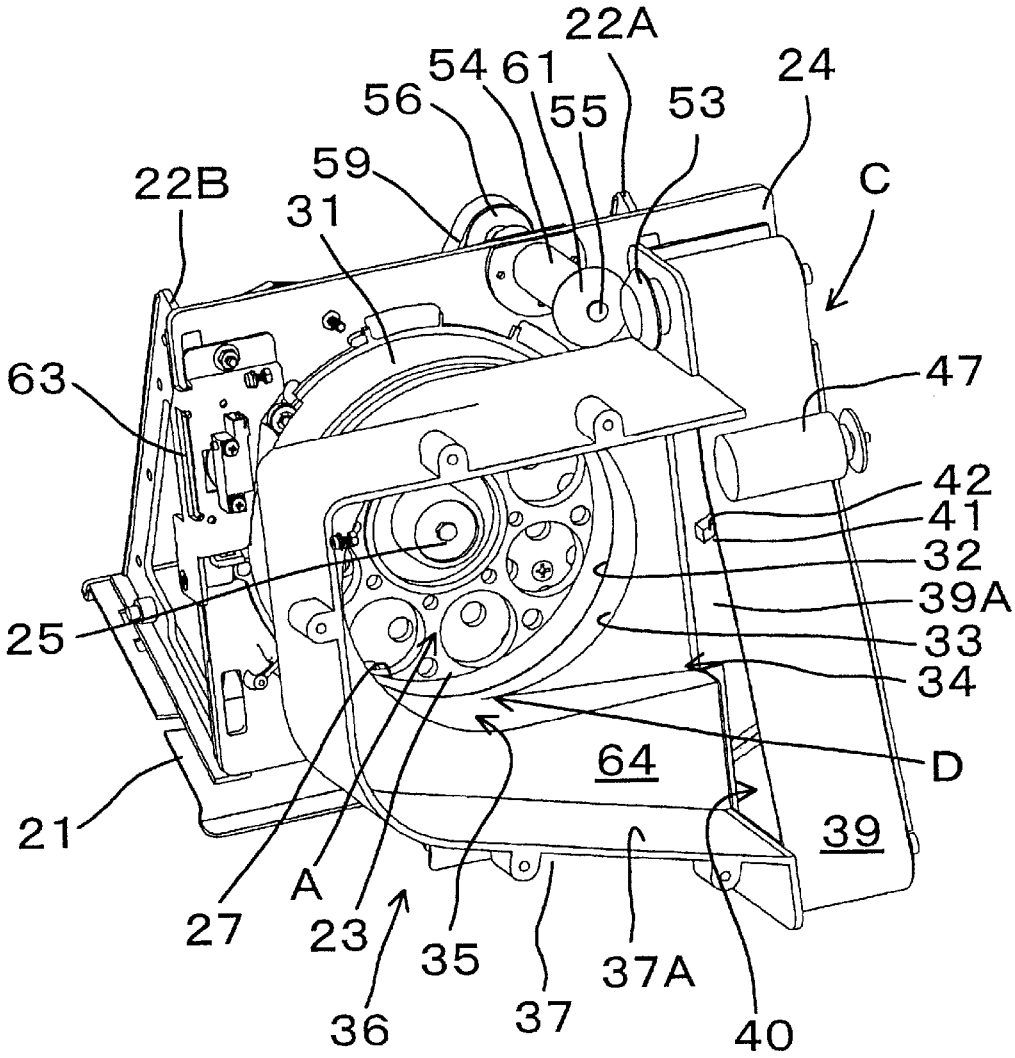
FIG. 4 is a right perspective side view of FIG. 1 with the coin bowl and coin carrier unit housing removed.

Referring to the views of FIGS. 1–5, a first embodiment of the present invention is disclosed. The coin hopper device 20 of the present invention is of a configuration that can be installed, for example, in gaming machines, product dispensing apparatus, etc. A substrate structure 21 can be used for fixing or mounting the coin hopper device within the frame of a gaming machine not shown. A pair of right angle and triangular board members 22*a* and 22*b* are attached to the upper surface of the substrate 21. These board members 22*a* and 22*b* are in turn attached to the support substrate 24 that is fixed at an appropriate tilt or slope to assist in the functioning of the coin hopper device and the gravity dispensing and movement of coins through the coin hopper device. A motor 29, such an electric motor, can be attached to a speed reducing member 28, which in turn can be connected to an output shaft 25 which rotatably extends through the support substrate 24. The shaft line or axis of the rotating shaft 25 is orthogonally positioned relative to the support substrate 24. As will be subsequently described, the speed reducing member 28 can also drive other operative members of the coin hopper device. As seen in FIG. 4, one end of the output rotating shaft 25 is affixed to a selecting rotating disc A. The rotating disc A includes a rotating disc member 23 with a plurality of holes or apertures that can be operatively aligned to be able to accept and select individual coins. The coins can be of a monetary nature, or could be medallions, tokens, etc.

Figure 1:
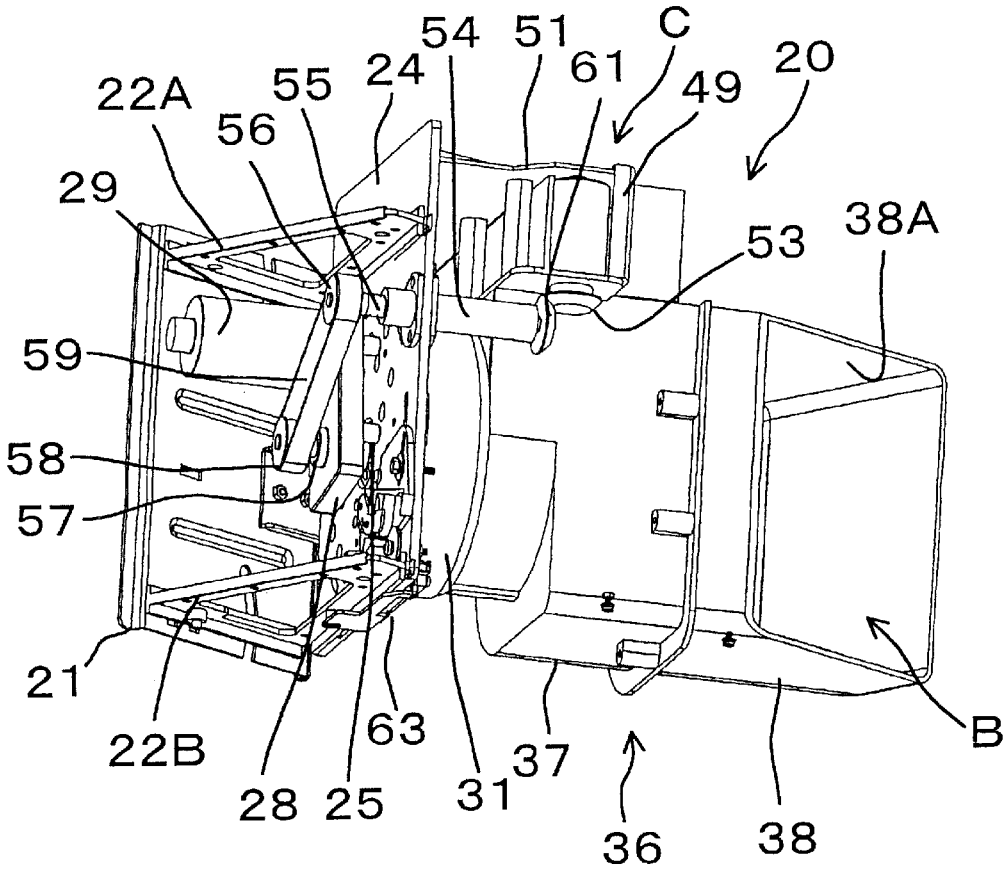
FIG. 1 is a perspective view of a first embodiment from an oblique upper view.

While not shown, a recess or pocket is formed in the back surface of the rotating disc adjacent the alignment holes 27 to receive a coin that is selected and is to be dispensed or paid out from the coin hopper device. As can be seen in FIGS. 1 and 4, a cylindrical support member 31 is fixed to the support substrate 24. As can be seen in FIG. 4, the support member 31 has a coin receiving portion 32 of a cylindrical configuration. This coin receiving portion 32 surrounds the rotating selector disc 23. A second coin receiving portion, or entrance configuration 33, is positioned upstream or on the coin hopper side, of the support member 31. Also, as seen in FIG. 4, a lower inclined coin acceptance division member 35 is provided immediately adjacent a first coin bowl 37. An opening 34 is provided on peripheral flank portion of the coin acceptance division member 35. The coin storage portion 32 and the coin entrance portion 33 constitute a coin retention division rotating disc D.

The coin bowl member 37 is disclosed in a trapezoidal configuration and forms a portion of the coin bowl 36. As can be seen in FIG. 2, a second coin bowl storage member 38 is fixed to the first coin bowl member 37 and has a rectangular box like configuration to optimize the potential storage in a narrow confined space. A coin acceptance mouth 30A is provided on the upper surface and the second coin bowl 38 is fixed to the first coin bowl 37. The respective first and second coin bowl members collectively constitute the coin bowl 36 for receiving the coins in bulk. The coin bowl 36 constitutes a coin retention division B having basically a rectangular configuration. As can be seen in FIG. 4, a first basal plane 37*a* of the coin bowl member 37 has a slope which tilts toward a carrier device C on the peripheral side. The slope or inclination of the basal plane 37*a* is sufficient so that a coin will slip or slide naturally by virtue of its own weight. A coin acceptance division 35 and the first basal plane 37 change in a step increment. The coin acceptance division 35 and the first basal plane 37*a* are connected or spaced by the wall 64. A second basal plane 38*a* of the second coin bowl member 38 represents an upward extension of the first basal plane 37*a*. That is, the second basal plane 38*a* of the second coin bowl member 38 tilts so that the bulk coins may slip by virtue of their weight and slide downward adjacent to wall 64. An opening 34 is provided at the top of the wall 64. A coin receiving side opening 40 is at the end of the plane 37*a*. The carrier device C receives the coins through these openings on the peripheral side.

The carrier device C includes an endless band or a plurality of link members that rotate in a counter-clockwise direction about an axis traverse to the axis of the rotating output shaft 25. As shown in the first embodiment, an endless band is formed into a belt 39 and includes slanted rectangular protrusions 41 that are fixed at regular intervals on the inner surface of the belt 39. Tilting or sloping downward and inward as shown in FIGS. 3 and 4, a driving roller 43*a* is installed on a shaft 44*a*. 44*b*, which is a guide roller mounted on a shaft 43B, and 43C, which is another guide roller mounted on a shaft 44*c*, are respectively mounted for free rotation. Both shafts 44*b* and 44*c* are fixed relative to the support 31. The arrangements of the driving roller 43*a*, guide rollers 43*b* and 43*c* are placed generally in a right angle triangular configuration. The lower portion of the belt is a coin receiving department 40 which contain the coins that fall from the opening 34.

Figure 5:
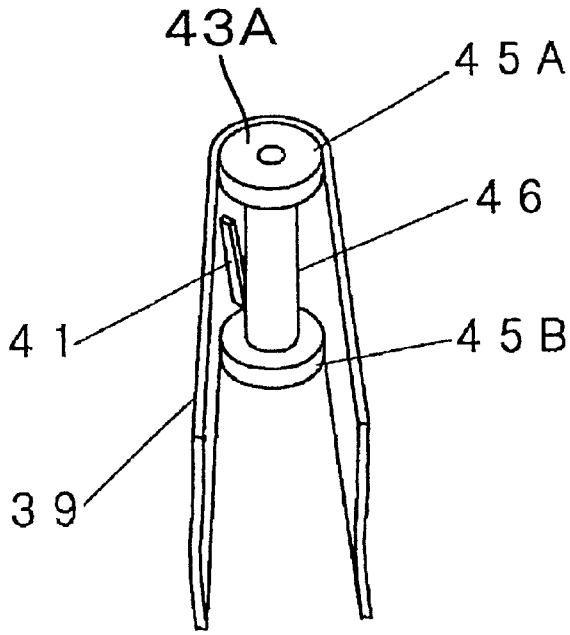
FIG. 5 is a perspective partial view of the guide roller and endless belt of the coin carrier unit.

Each of the respective guide rollers and the driving roller 43*a* have similar configurations. Referring to FIG. 5, the driving roller 43*a* has a smaller diameter shaft 46 between support discs 45*a* and 45*b* that can drive the belt 39. The reduced diameter shaft 46 accommodates the passage of the coin lifting protrusion 41. Mounted on the exterior surface 39 is a tension roller 47 that is freely rotated on a shaft 48. The only driving shaft is the shaft 44*a* on the driving roller 43*a*. The rotation of the belt 39 constitutes a coin carrier division 39*a* as shown in FIG. 2. The coin carrier division 39*a* moves in a plane that is almost orthogonal with the inclined output shaft of the rotating disc 23. That is to say, the coin carrying division 39*a* has an endless belt 39 that tilts at an angle which is almost equal to the angle of the rotating disc 23. Element 49 is a storing or housing body for the carrier device C and can be positioned stationary with the support 31. Housing body 49 is positioned adjacent one side of the coin bowl member 37 and the opening 34. An outer cover member 51 is attached across the opening 52 of the housing body 49. Cover member 51 can be seen in FIG. 1 and is fixed to the housing body 49 and to the support substrate 24.

The driving shaft 44*a* is connected to a bevel gear 53. A bearing member 54 extends outward from the support substrate 24 and supports therein a rotating shaft 55 which is in turn connected to a bevel gear 61 at one end of the bearing member 54 and connected at the other end to a timing pulley 56 which is connected via a timing belt 59 to a speed reduction unit 28. Thus, by virtue of the power output from the shaft 57 in the speed reducing unit 28, the driving power of the motor 29, such as an electric motor, can not only drive the rotating selector disc 23, but also the endless belt 39.

As can be seen in FIG. 1, the aperture exit 63 is where the coins that are sent out from the rotating selector disc 23 are released from the coin dispensing hopper.

Coins can be placed in bulk into the coin acceptance division 35, the second attaching part 33, and the first coin attaching part 32 until the coins reach the open acceptance mouth 38*a* of the coin bowl 36. With a full inventory of coins, the motor 29 can rotate the rotating selector disc 23 when a signal indicates that a coin or coins are to be output. The coins are aligned and selected by the rotating disc 23 and passed through an alignment hole 27 to reach the back side of the rotating disc 23. The coins can be contained in the pocket or recess (not shown) from which they are sent out from the exit 63. When the number of coins are reduced by being dispensed, the coins in the first coin bowl member 37 can pass through the opening 34 by the inclination of the basal plane 37*a*. The coins will slip into the coin receiving department 40 and the carrier device C can be activated so that the shaft 44*a* will be rotated also by the electric motor 29.

As shown in FIGS. 2 and 3, the driving roller 43*a* will be rotated in a counter-clockwise rotation direction. The belt 39 will accordingly move through the coin receiving department 40 so that coins which are located on the belt 39 will be carried upward by the movement of the belt 39. That is to say, the coins will be carried in the coin carrying plane 42 of the protrusion 41. The coins will accordingly be lifted up until they are released and will fall through the second attaching part 34 as it passes through the opening 34. The coins will fall through the first coin attaching part 32 by the inclination so that they can be transmitted to the rotating selector disc 23. As can be appreciated, as the coin level drops, the coins will slide down the basal plane 37*a* to enter into the coin receiving department 40. The end wall adjacent to belt 39 of the step 64 assures that a coin is lifted up so that it can, as before, fall into the second attaching part 33. By the dropping of the coins into the second attaching part, any coins which attempted to form a bridge can be jarred by the newly dropped coins to thereby destroy any bridge or jamming of the coins.

It should be appreciated, the belt 39 could be driven by a separate motor than the electric motor 29, if so desired. Additionally, the second coin bowl 38 can be expanded above the rotating selector disc 23. In this manner, the capacity of the coin bowl would increase. The carrier device can also be constituted by a rotating plate which rotates on a coin receiving department 40 side or the opening 34 side. The rotating plate would, of course, require a protrusion to lift the coins in the coin receiving department 40.

A second embodiment of the invention is disclosed in FIGS. 6–10. Identical parts from the first embodiment will carry the same reference numbers to assist in the description. The rotating disc A of the second embodiment has a rotating selector disc 73 with a series of peripheral pins 72 that are regularly spaced about the perimeter of the disc 73. The rotating disc 73 is attached to the tip of the output rotating shaft 25 and is positioned to be approximately 60 degrees to the horizontal. Agitator elements 75 having arms 74 are fixed on the surface of the rotating disc 73. A support bowl 76 of a bucket shape is fixed to the support substrate 24. The rotating selector disc 73 is located in a circular opening 77 of the support bowl 76. An outer opening 78 is formed in the upper part sidewall of the support bowl 76 for receiving the bulk coins. The support bowl 76 constitutes a coin retention division D. The basal plane 76*b* of support bowl 76 tilts away so that a coin may slip by its weight to the rotating selector disc 73. A knife edge member 79 shown in FIG. 6 will receive the coins as they are dispensed from the rotating selector disc 73. A hopper roller 80 cooperates with the coin received in the knife member 79 to permit the coin to exit through the aperture 63. As a result of the pivotal operation of the hopper roller 80 and a switch (not shown), the individual coins can be counted as they are dispensed.

Figure 6:
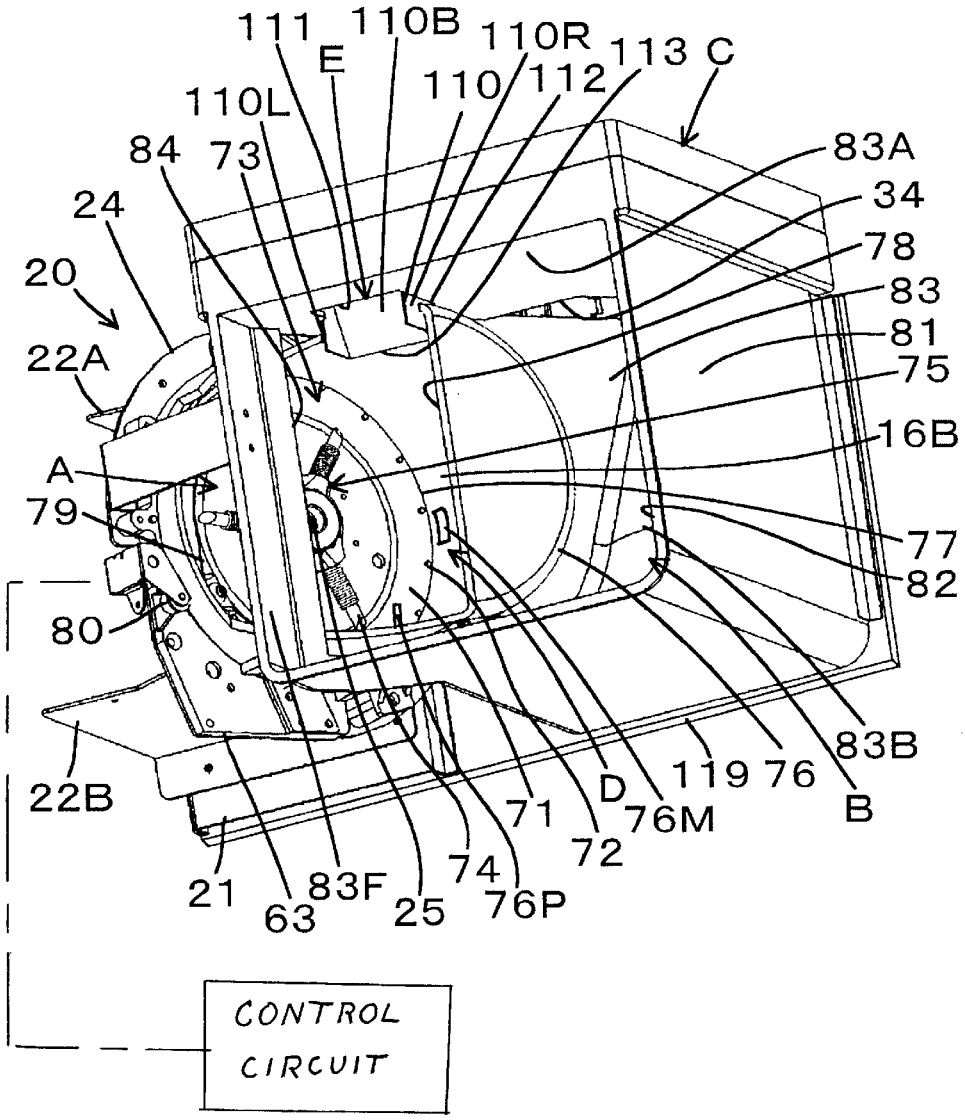
FIG. 6 is an upper perspective view of a second embodiment looking downward from an oblique angle.

An electrode 76*m*, as shown in FIG. 6, is fixed in the vicinity of the basal plane 76*b* of the support bowl 76 adjacent a perimeter of the rotating selector disc 73. A first electrode 76*p* is fixed on a position of the sidewall of the support bowl 76. A second electrode 76*p* is placed further up than the electrode 76*m*. The coins that contact these electrodes will give an indication of the inventory of coins that are currently stored within the coin hopper. A control circuit that can include a microprocessor with appropriate programming can coordinate the counting and dispensing of coins, the operation of the motor for driving the rotating disc 73 and the coin carrying device C, and the monitoring of the electrodes 77*m* and 76*p*.

A square, tubular coin retention body 81 has an upper surface opening with a mouth 82. The inside of the coin retention body 81 constitutes the coin retention division 83.

The support bowl 76 protrudes for a coin retention division 83 from the opening 84 of the sidewall 83*f*. Accordingly, the shaft line of the output rotating selector disc 73 is located operatively relative to the support bowl 76 and the coin retention division 83.

Figure 7:
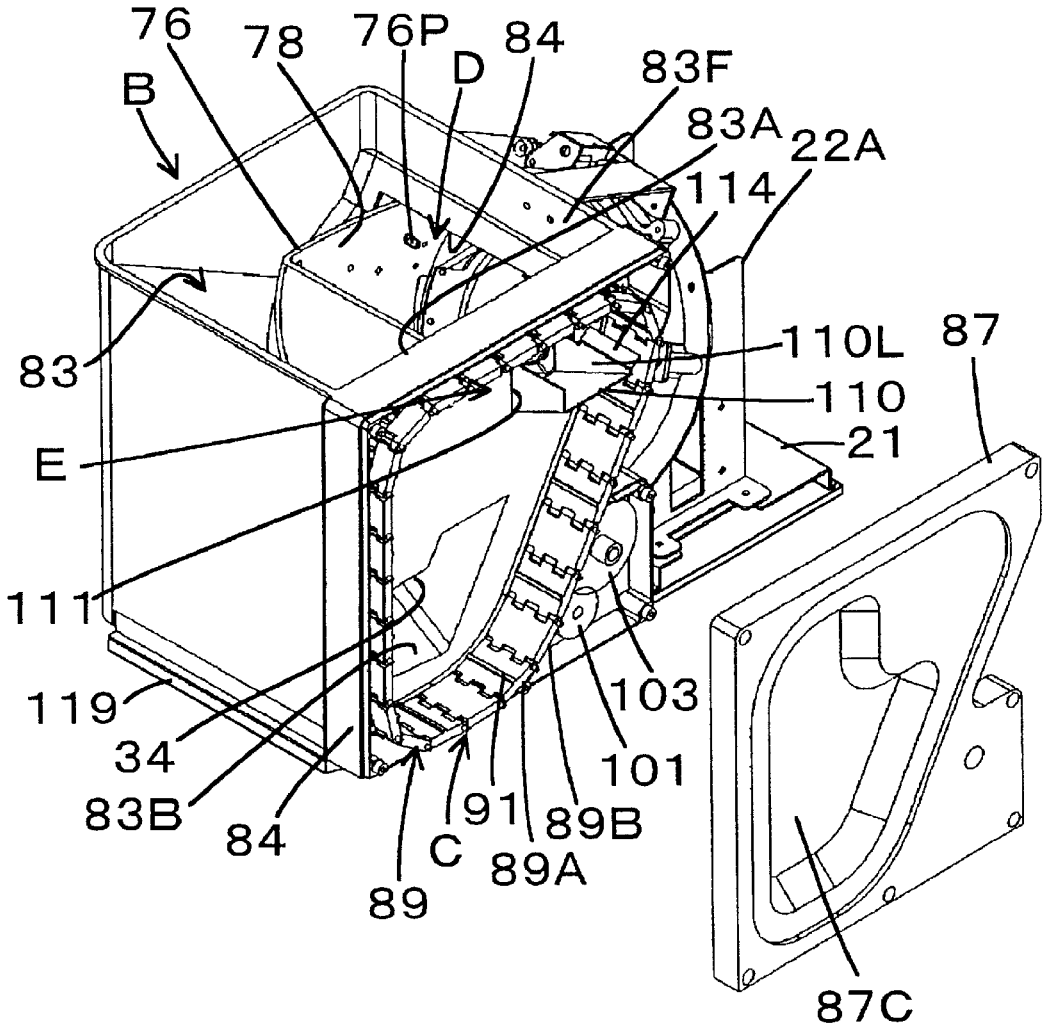
FIG. 7 is a rear side perspective view of FIG. 6 with a portion of the coin carrier unit housing removed.
Figure 8:
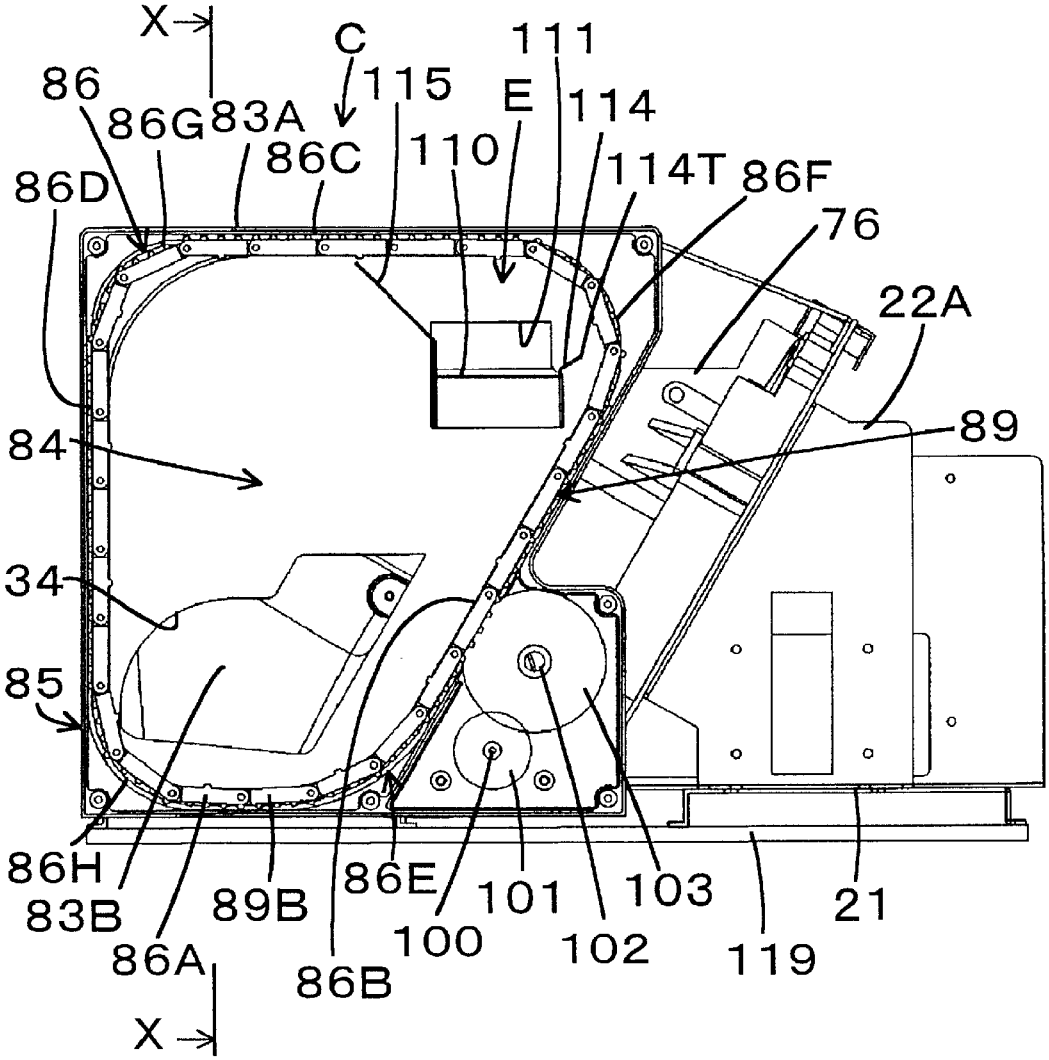
FIG. 8 is a rear side elevated view with a portion of the housing of the coin carrier unit removed.
Figure 9:
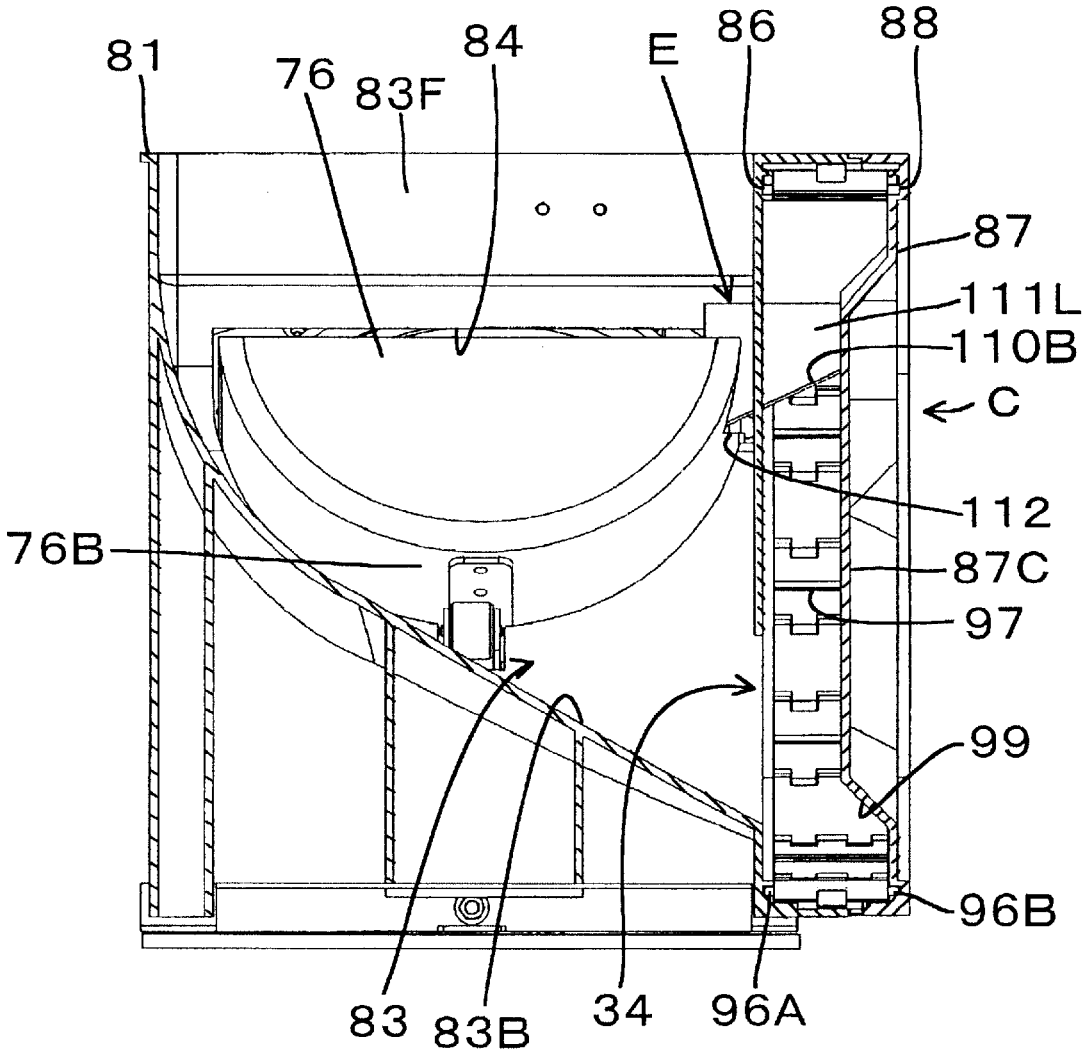
FIG. 9 is a cross sectional view taken along the lines X—X of FIG. 8.
Figure 10:
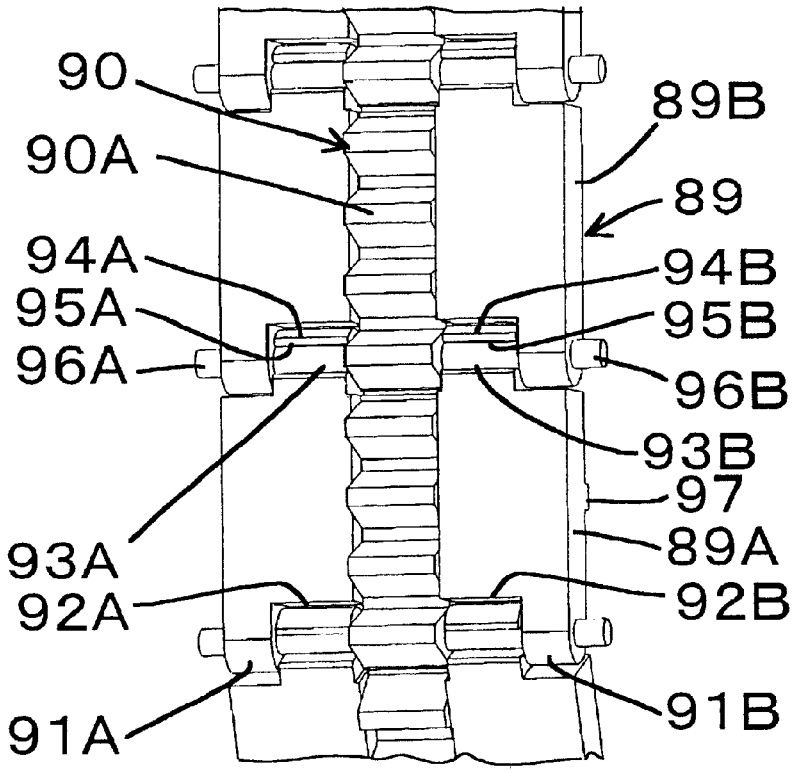
FIG. 10 is a partial perspective view of the links of an endless crawler or coin carrying web.

A coin carrying device C is installed on an outer side of the sidewall 83*a* of the coin retention body 81 shown in FIG. 6. As can be seen, an opening 34, as shown in FIG. 8, is aligned with a sloping basal plane 83B within the coin retention division 83 so that coins, by their weight, will slide into the coin carrier device C through the opening 34. The coin storing division 85 takes the shape of an inverted trapezoid. Within the coin storing division 85, a first guide groove 86 is formed so that it can guide a crawler or link belt member 89 of an endless configuration. The first guide groove 86 has a cross-sectional rectangular configuration and a width of a size which can easily move a first guide pin 96*a*, as shown in FIG. 10. The first guide groove 86, as shown in FIG. 8, includes a bottom horizontal portion 86*a* and a sloping portion 86*b*. A top horizontal portion 86*c* and a vertical portion 86*d* complete the loop of the first guide groove 86. The bottom horizontal portion 86*a* is located below the retention division opening 34. The slope of the guide groove 86*b* is approximately parallel with that of the surface of the rotating selector disc 73. The top horizontal portion 86*c* extends across the coin delivery device E. The interfaces between each of the belt portions have an arch configuration to facilitate the movement of a link belt or crawler 89. Thus, all the guide pins 96*a* are able to move in the first guide groove 86 despite the bending along the length of the crawler 89. An outer opening, or cover 87, as shown in FIGS. 7 and 9, provide a cover to the coin carrier device C. A second guide groove 88 is isometric with the first guide groove 86 and is formed along the inner surface of the cover or operculum 87.

The endless link belt, or crawler 89, can be seen in FIG. 10. To provide proper spacing for coin protrusions 97, a plane link 89*b* is spaced between each of the links 89*a* having the protrusions 97. Each of these links, or crawler pieces, 89*a* and 89*b*, have central rack teeth 90*a* along a midline or external surface center. The lower side shown in FIG. 10 of each of the link or crawler pieces are a first support piece 91*a* and a second support piece 91*b*. They fit within the upper notches or openings of the concavities 92*a* and 92*b* that can be formed in the individual link members. As can be appreciated, the link members could be made from a plastic resin in a mold. A first section conjunction rod 93 is located between the tip of the first support piece 91*a* and the tip of the rack tooth 90*a*. A second section conjunction rod 93*b* is located between the tip of the second support piece 91*b* and the tip of the rack tooth 90*a*. These respective conjunction rods 93*a* and 93*b* can have a round configuration. A first hook 94*a* and a second hook 94*b* can extend over the conjunction rods 93*a* and 93*b* to be mounted within the respective first groove 95*a* of a U configuration with an opened mouth, and the second groove 95*b* of a U configuration with an opened mouth formed on the respective first hook 94*a* and the second hook 94*b*.

The first guide pin 96*a* and the second guide pin 96*b* extend outward along the side of the belt web or crawler 89 and may be respectively an extension of the first section conjunction rod 93*a* and the second section conjunction rod 93*b*.

The coin protrusion 97 is positioned on the inner surface of the crawler piece 89*a*. The protrusion 97 has been formed in a direction which is orthogonal to the column of the rack tooth 90*a*. By combining the respective crawler pieces 89*a* and 89*b*, a flexible endless web member is created. The collective rack tooths 90*a* form the rack member 90 that can be appropriately driven within its enclosed track configuration. The first guide pin 96*a* are inserted into the first guide grooves 86 of the side wall 83*a*. A cover, or operculum 97, is then provided so that the second guide pin 96*b* will be inserted into a second guide groove 88 of the cover 97. Along the center of the operculum is a convex indentation 87*c* shown in FIG. 9 which assists in aligning the coins to be picked up by the protrusions 97 on the crawler 89. Guide slope 99 is formed over the side horizontal part 86*a* of the guide groove of convex division 87*c*. A driving shaft 100 shown in FIG. 8 can be rotated by the speed reducer through the action of the motor 115. The driving shaft 100 rotates freely within the installed side wall 83*a*. A drive gear 101 is fixed on the driving shaft 100 and can engage a gear 103 which has been rotatably mounted on a shaft 102 which is also fixed on the side wall 83*a*. The gear 103 directly engages the rack member 90 along the central back portion of the crawler member 89. Thus, the crawler 89 is positively driven to circulate in a counter-clockwise rotation direction as a result of the drive of the gear 103.

Referring to FIG. 7, it can be seen that the cover 87 in the upper right hand portion, is designed to accommodate a chute 110 that is to receive the coins carried by the crawler 89 so that they will be dropped onto the chute as the crawler 89 bends to extend along the upper top horizontal portion 86*c*. This chute is part of a coin delivery device E. The chute 110 is positioned below the circular arc part 86*e* and includes an inclined base plate 110*b* as shown in FIG. 9, and side walls 110*l* and 110*r* as shown in FIG. 6. The chute 110 penetrates the opening 111 of the side wall 83*a* and is located within a notch 112 on the side wall of the support bowl 76. The lower tip 113 of the chute 110 is within the opening 78 of the support bowl 76. The upper end portion of the side wall 110*l* constitutes a first inclination slide way 114 by being bent to the rotating selector disc side 73. The position of the upper end 114*t* of the first inclination slide way 114 has been positioned so that when the first section conjunction rod 93*a* and the second section conjunction rod 93*b* act as a supporting point in the bending of the crawler 89, the crawler 89 will release its coin into the chute 110. Since the upper end 114*t* is located lower than the center of the falling coins C, and at such a position that it will permit one coin to fall without contact, but if two coins are inadvertently carried, the upper coin will be knocked off. The upper end division of the side wall 110*r* is bent towards the rotating selector disc 73 and constitutes a second inclination slide way 115. Thus, as can be appreciated, coins that have entered through the opening 34, can be positioned on the endless crawler 89 and then released into the support bowl 76.

Figure 11:
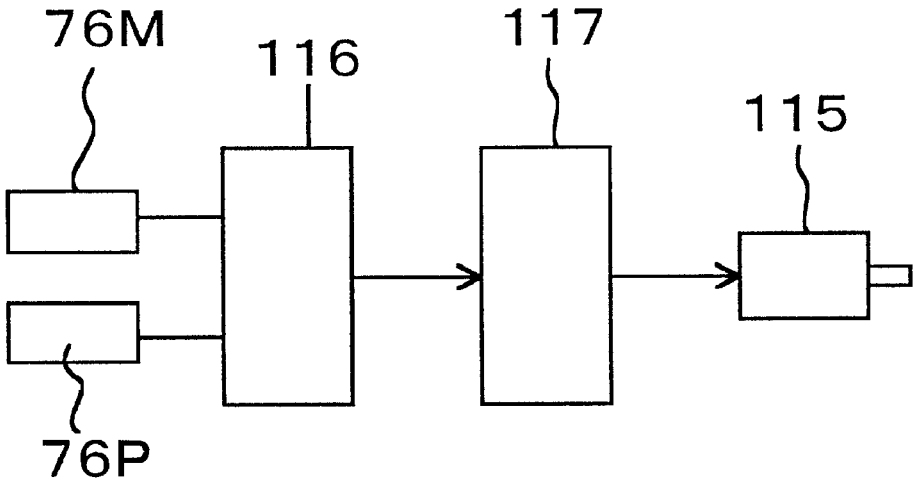
FIG. 11 is a schematic of the control circuit.

Referring to FIG. 11, the control circuit of motor 115 which rotates the driving shaft 100, is explained. The respective electrodes 76*m* and 76*p* are appropriately connected to a discrimination circuit 116. The output of this discrimination circuit indicates a normal signal when current is flowing between electrode 76*m* and electrode 76*p* by virtue of the conductive coins providing an electrical connection path. A signal is not output when current is interrupted between the electrodes 76*m* and 76*p*. The motor drive circuit 117 can be activated to drive the motor 115 when an insufficient current signal is received from the discrimination circuit 116. Referring to FIG. 8, the substrate structure 21 and the coin retention body 81 are respectively fixed onto a bed 119 which is used as a base in order to fix the coin hopper 20 in the frame of a game machine or coin dispensing apparatus.

The operation of the second embodiment of the present invention can be explained as follows.

Bulk coins are supplied in coin retention division 83 and the coin support bowl 76. The coins in the coin support bowl 76 are stirred by rotation of a rotating selecting disc 73 and the appropriate coin agitators 75 that extend radially outward. The coins can be picked up between the respective pins 72 and as the disc 73 rotates in a counter-clockwise direction, the coins are lifted upward until they contact the selecting knife 79. The knife releases the coins from the rotating disc 73 and they are sent to the exit aperture 63. The movement of the coins contacts a sensor connected to a hopper roller 80 and they are appropriately monitored and counted.

As the coins in the coin support bowl 76 are depleted and slide downward by the inclination of the basal plane 96*b* of the support bowl, the continuity of the coins between the electrodes 76*m* and 76*p* will be interrupted and a current flow will cease. As a result, the discriminating circuit 116 will output an appropriate signal upon which the motor drive circuit 117 can then activate the motor 115. Gear 103 is then rotated by the rotation of the motor 115 in a clockwise direction and the rack teeth 91 on the crawler 89 will then be continuously driven by the rotation of the gear 103. The respective first guide pin 96*a* and second guide pin 96*b* will retain the crawler within the designated pathway through engagement with the first guide groove 86 and the second guide groove 88. Coins within the coin retention division 83 will slip down by a gravity feed based on the inclination of the retention division basal plane 83*b*. The coins will pile up on the inner surface of the crawler 89 along the bottom horizontal portion 86*a*. As the coins pile up on the inner surface of the crawler 89, they can come into contact with the guide slope 99 of the operculum 87 and they can be dispersed across the crawler 89 on the bottom horizontal portion 86*a*. The individual coins will be retained by the coin protrusion 97 and will be carried up the passing slope 86*b*. At the upper bend 86*f*, the links of the crawler 89 will bend by the operation of the first section conjunction rod 93*a* and the second section conjunction rod 93*b*. Therefore, the crawler link 89*a* or 89*b* will push the upper end of the coin that is being pushed up by the protrusion 97 so that the coin will be deposited within the chute 110. The coin falls into the chute 110 in a time period before the coin will contact the tip 114T. The upper end 114T of the first inclination slide way if 114 is positioned downward from that of the center of the falling coin. Thus, the coin by its own weight, will contact the first inclination slide way 114 and slide to fall into the base plate 110*b* whereby it will be released from the lower tip 113 to fall within the coin support bowl 76. The cooperative efforts of the first inclination slide way 114 or the second inclination slide way 115 ensures that the coin will fall in the base plate 110*b* so that the coins in the coin retention division 83 will be continuously supplied by the carrier device C to the coin support bowl 76. When a sufficient number of coins are deposited into a support bowl 76, the electrodes 76*m* and 76*p* will then be connected to close a circuit and the discrimination circuit will detect this contact and thereby cause the motor drive circuit 117 to stop the rotation of the motor 115.

As can be appreciated, the optimum desired quantity of coins that would be contacting the rotating selector disc can be set as a first quantity of coins as a result of the delivery means of the present embodiment. The coins in bulk storage are a second quantity of coins. As a result, jamming through the formation of coin bridges on the rotating selector disc can be avoided.

Figure 12:
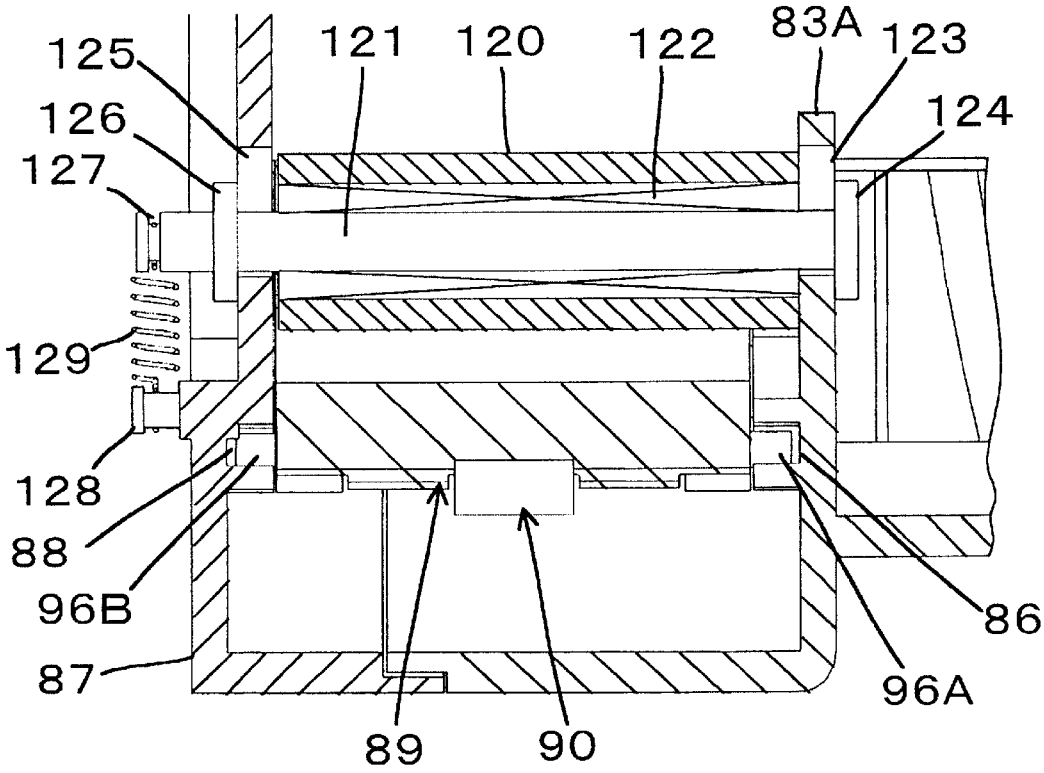
FIG. 12 is a cross-sectional view taken along the section Y—Y of FIG. 13.
Figure 13:
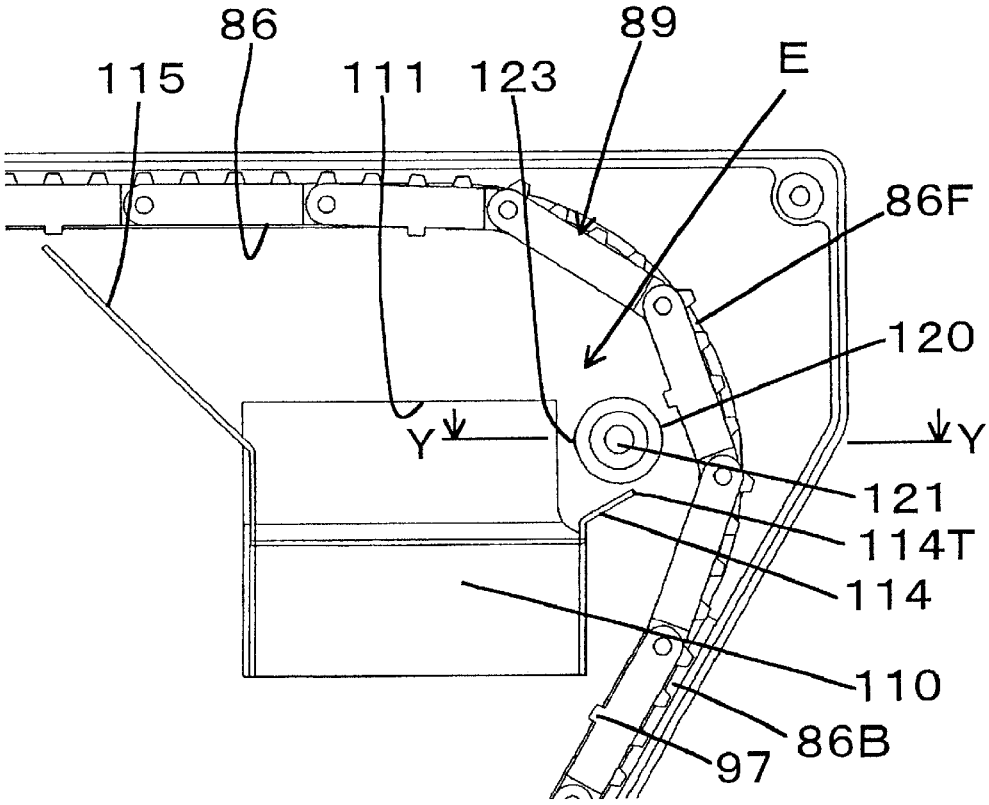
FIG. 13 is a partial side view of FIG. 8.

The mounting of a guide roller 120 for preventing a jamming of coins on the crawler 89 is disclosed with regards to FIGS. 12 and 13. The guide roller 120 is mounted above an inclination slide way 114 that is part of the chute 110. A cross section of the guide roller is shown along the lines Y—Y of FIG. 13 in FIG. 12. The guide roller 120 rotates in a counter-clockwise rotation direction only. It does not rotate in a clockwise direction. A portion of the shaft 121 is able to slide in a horizontal direction along an elongated hole 123 formed in the side wall 83*a*. A stopper member 124 is fixed at the tip of the shaft 121 to journal it within the hole 123. At the other end, a guide ring 126 is fixed on the shaft 121 so that the shaft 121 can slide within an elongated hole 125 within the operculum 87. A tension spring 129 is connected by the groove 127 on the tip of the shaft 121 and to a protrusion 128 from the operculum 87. As a result, the guide roller will be given a spring force or biasing force towards the side of the crawler 89. That is, the guide roller 121 will be located at one extreme in the respective elongated holes 123 and 125. In this position, a coin will not contact a circumferential surface of the guide roller 120 when only one coin is carried by the crawler 89. As seen in FIG. 12, the coin will fit between the gap on the carrier 89 and the surface of the guide roller 120. However, if two coins are adhered together, the upper coin will contact the guide roller and the guide roller will be displaced as it is contacting and scraping the extra coin off of the crawler 89.

Thus, as the coin is moved upward and contacts a protrusion 97 on the crawler 89, the crawler will push the upper end of the coin in a counter-clockwise direction in FIG. 8 towards the chute 110. As gravity starts to pull the coin downward at the bend of the crawler 89, the coin will pivot about its supporting contact with the protrusion 97. The crawler 89 will continue to push the coin upward and the coin will contact the outer circumferential surface of the guide roller 120. The coin guide roller 120 can rotate in a clockwise direction and thereby permit the coin to pass over the guide roller and fall into the chute 110. The center of gravity of the coin will be over the center of the guide roller 120 on the side of the chute 110. The coin will then proceed forward to fall into the coin support bowl 76.

If, however, a pair of coins are inadvertently carried by the crawler 89, the coin on top will contact with the guide roller 120 and will be scraped off by the guide roller 120. As can be understood, the guide roller 120 is freely mounted on the shaft 121 and is not driven.

An alternative third embodiment can be explained with reference to FIGS. 14 and 15 and the same common reference numbers will be used in this embodiment.

Figure 14:
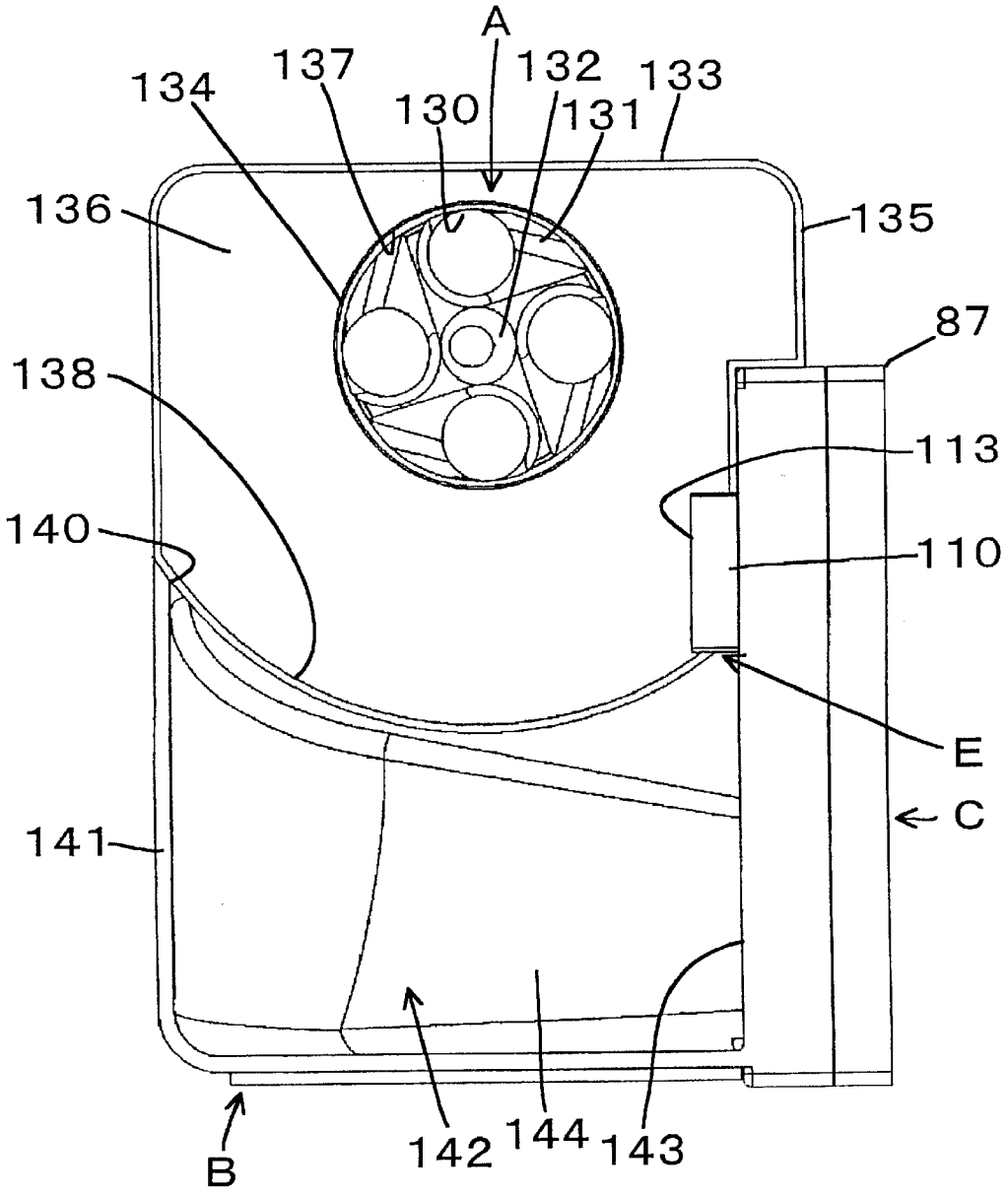
FIG. 14 is a top view of a third embodiment.
Figure 15:
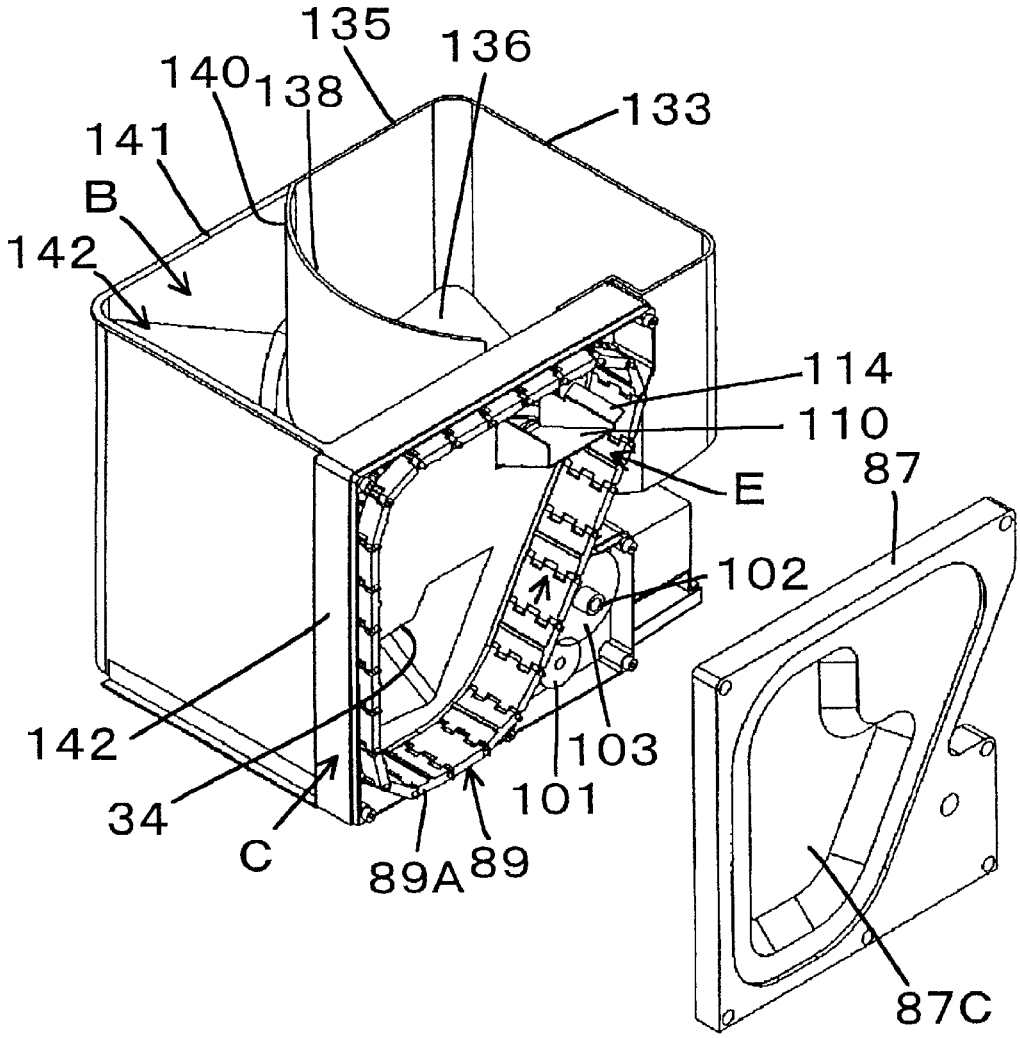
FIG. 15 is a left side perspective view with a housing removed of a third embodiment.
Figure 16:
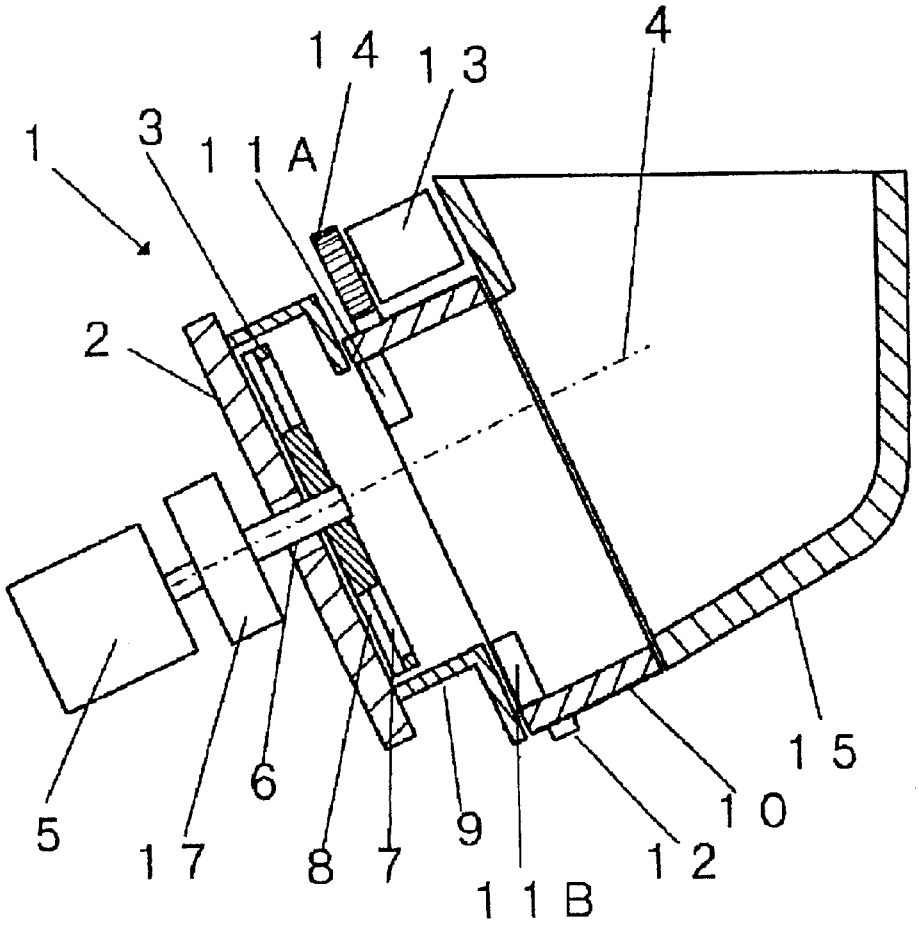
FIG. 16 is a schematic cross-sectional view of a prior art device.

As can be seen in FIG. 14, the selecting rotating disc 4 has multiple alignment holes 130 formed at regular intervals. The selecting rotating disc A is a horizontally mounted rotating disc 131 which has a pocket or recess not shown on the back surface of the alignment holes 130. This pocket will accept coins that have been selected and will send them to a release position. Mounted above the rotating selector disc 131 is a coin support compass bowl 133 having a cylindrical lower end 134 and a substantially rectangular upper open end 135. An incline wall 136 is designed to slide the coins by gravity feed to the rotating selector disc 131. The horizontal rotating disc 131 is mounted within the circular aperture or hole 137 in a lower portion of the cylindrical support compass bowl 133. A supplemental rectangular tubular coin retention member 141 is placed on one side of the support bowl 133. This coin retention body 141 is formed with an opening 140 which is cut into one wall surface. The retention division 142 is created by fitting the convex wall 138 of the support bowl 133 into the opening 140 of the coin retention body 141. Thus, a retention division 142 of a rectangular state is composed of the coin retention body 141 and the convex wall 148. This retention division 142 is a coin retention division B.

A coin carrier device is positioned adjacent to side wall 143 on the side of the horizontal rotating disc 131. This coin carrier device C has a construction which is identical with the coin carrier device E of the second embodiment. A retention division opening 34 is formed between the retention division 142 of the side wall 143. The delivery device for the coins is identical to the delivery device in the second embodiment. Thus, the chute 110 has a lower tip 113 that is positioned above the support bowl 133. The bottom wall 144 of the retention division 142 tilts towards the retention division opening 34 and towards the horizontal rotating disc side. The inclination of these angles permits the coins to slide naturally under a gravity feed to the coin carrier device C. While not shown, the electrode monitoring sensors that are connected to a discrimination circuit can also be employed within the support bowl 133.

In the operation of the third embodiment, coins are supplied to the support bowl 133 and also to the coin retention division B. The coins in the support compass bowl 133 are then selected by the rotation of the horizontal rotating selector disc 131. The bulk coins supplied in the retention division 142 will slide downward to the retention division opening 34 as a result of the inclination of the bottom wall 144. The coins will pile up on the inner surface of the underside horizontal portion of the crawler 89. When the coins in the support compass bowl are sufficiently lowered to break the electrical connection between the electrodes (not shown), then the discrimination circuit can cause the motor 115 to operate and to drive the gear 103, which in turn, drives the crawler 89. The coins are pushed up by the protrusions 97 to be released onto the chute 110. The coins which fall onto the chute 110 will slide down by the inclination of the base plate 110*b* and therefore be supplied to the support compass bowl 133. When a sufficient quantity of coins are supplied by the crawler 89 to the support compass bowl 133, the circuit between the electrodes will be completed and the motor 115 will stop rotating.

As should be apparent from the above embodiments, it is possible to make various modifications without parting from the scope and spirit of the present invention. For example, with appropriate modification, it is possible to substitute the crawler of the second embodiment for the belt of the first embodiment. Additionally, the rotating selector disc can take many different forms as would be known by persons of skill in this field. It is also possible to add the guide roller of the first embodiment to the second embodiment. Additionally, the coin carrying device can be positioned on either side of the rotating disc with an appropriate alignment of the inclining planes in the coin storage members. The coin carrier device can also be a rotating plate which rotates on the coin retention division side or rotating disc side. As can be further appreciated, the driving motor of the rotating disc and of the coin carrier disc can be made to rotate at the same time with the crawler speed being reduced to a relatively low speed rotation to continuously supply coins to the rotating selector disc. In this case, it would not be necessary to provide sensors within the supply coin bowl as long as the speed of the crawler does not overload the capacity of the coin supply bowl.

Those skilled in the art will appreciate that various adaptions and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A coin hopper device for dispersing coins comprising:

a coin selecting mechanism which includes a rotating disc which pushes out coins one by one and a coin-retention-division which is located in front of the rotating disc, for storing a first quantity of coins and selecting coins that are to be dispensed;

a coin storage member for storing a second quantity of coins in bulk and directly permitting coins to pass operatively to the coin selecting mechanism from the coin storage member along the first direction when the stored coins are at a predetermined height and is located below the coin-retention division; and a coin carrier device mounted along one side of respectively the coin selecting mechanism and the coin storage member for removing coins from one side of the coin storage member, elevating the coins and dropping the coins into the coin selecting mechanism from the same side.

2. The coin hopper device of claim 1, wherein the coin carrier device includes an endless belt member rotating about an axis traverse to the first direction.

3. The coin hopper device of claim 2, wherein the endless belt member includes a plurality of pivoting links and a plurality of diagonally slanting protrusions.

4. The coin hopper device of claim 2, further including a guide roller for limiting the number of coins at any one position of the endless belt member.

5. The coin hopper device of claim 4, wherein the coin storage member has a coin support surface extending downwards in a traverse direction to the first direction.

6. The coin hopper device of claim 1, further including an endless belt member with coin lifting protrusions rotating about an axis traverse to the first direction and a chute member protrusion within and below a rotation path of the endless belt to receive coins from the endless belt member and to deposit the coins in the coin selecting mechanism.

7. The coin hopper device of claim 6, wherein the endless belt member is formed from a plurality of link member with a central rack of teeth.

8. The coin hopper device of claim 7, wherein the plurality of link members have side guide pins.

9. The coin hopper device of claim 8, wherein the endless band member has a plurality of protrusions extending across an inner surface at fixed position.

10. The coin hopper device of claim 9, wherein the endless band member is formed from individual links that are pivotally connected to each other.

11. A coin hopper device for dispensing coins comprising:

a coin selecting mechanism which includes a rotating disc which is slanted and pushes out coins one by one and a coin-retention-division which is located in front of the rotating disc, for storing a first quantity of coins and selecting coins that are to be dispensed; a coin storage member which is located opposite to the rotating disc and is located below the coin-retention-division and for storing a second quantity of coins in bulk and directly permitting coins to pass operatively to the coin selecting mechanism from the coin storage member along a first direction when the stored coins are at a predetermined height; and a coin carrier device which is located parallel to the coin selecting mechanism and the coin storage member for removing coins from one side of the coin storage member, elevating the coins and dropping them into the coin retention division from the same side.

12. The coin hopper device of claim 11, wherein the coin carrier device includes an endless band member.

13. The coin hopper device of claim 11, further including a single motor that drives both the coin selecting mechanism and the coin carrier device.

14. The coin hopper device of claim 11, further including a coin quantity detection unit and a control circuit that can activate a transfer of coins by the coin carrier device when the coin quantity detection unit indicates a predetermined number of coins have been dispensed.

15. A coin hopper device for dispensing coins comprising:

a rotating disc which pushes out coins one by one;

a coin-retention-division which is located in front of the rotating disc and is slanted downwards towards the rotating disc for storing a first quantity of coins; and a coin storage member which includes a sloping surface that extends traverse to the rotating axis of the rotating disc and is located opposite to the rotating disc and is located below the coin-retention-division and for storing a second quantity of coins in bulk and directly permitting coins to pass operatively to the coin retention division from the coin storage member along a first direction when the stored coins are at a predetermined height, a coin carrier device which is mounted parallel to the coin retention division and the coin storage member for removing coins from one side of the coin storage member, elevating the coins and dropping them into the coin retention division from the same side.

16. The coin hopper device of claim 15, wherein the endless belt member includes a plurality of link members having a protrusion on an inner surface to lift a coin and guide pins on side surfaces and a cover member having an endless guide groove for receiving a guide pin to encompass the endless belt member.

17. The coin hopper device of claim 16, further including a coin quantity detection unit and a control circuit that can activate a transfer of coins by the coin carrier device when the coin quantity detection unit indicates a predetermined number of coins have been dispensed.

* * * * *